United States Patent [19]

Fields

[11] Patent Number: 4,512,756

[45] Date of Patent: Apr. 23, 1985

[54] APPARATUS FOR FEEDING FROM A HOPPER AND FOR SETTING UP COLLAPSED ARTICLE CARRIERS

[75] Inventor: Willie M. Fields, Griffin, Ga.

[73] Assignee: The Mead Corporation, Dayton, Ohio

[21] Appl. No.: 342,179

[22] Filed: Jan. 25, 1982

[51] Int. Cl.[3] ..... B31B 1/78; B31B 1/80

[52] U.S. Cl. ..... 493/312; 493/316; 493/909

[58] Field of Search ..... 493/312, 313, 316, 123, 493/124, 127, 138, 912, 909; 53/48, 398, 458, 564, 585

[56] References Cited

U.S. PATENT DOCUMENTS

| | | | |
|---|---|---|---|
| 2,887,022 | 5/1959 | Lubersky et al. | 493/124 |
| 2,956,483 | 10/1960 | Hartbauer | 493/313 |
| 3,015,923 | 1/1962 | Dotzenroth | 53/48 |
| 3,741,082 | 6/1973 | Sorensen et al. | 493/316 |
| 3,750,931 | 8/1973 | Dick | 493/316 |
| 3,896,711 | 7/1975 | Vuilleumier | 493/316 X |
| 3,991,660 | 11/1976 | Calvert et al. | 493/316 |
| 4,066,009 | 1/1978 | Calvert et al. | 493/316 |
| 4,213,283 | 7/1980 | Calvert et al. | 53/48 |
| 4,339,032 | 7/1982 | Wood | 206/158 |

FOREIGN PATENT DOCUMENTS

| | | | |
|---|---|---|---|
| 87441 | 5/1983 | Norway | 53/384 X |

*Primary Examiner*—Rodney H. Bonck

*Attorney, Agent, or Firm*—Rodgers & Rodgers

[57] ABSTRACT

Carriers of the top gripping type and having downwardly depending side and end walls and stacked in collapsed condition in a hopper are fed in sequence by oscillatable feeder means which engages a lower planar element of the lowermost carton in the stack of cartons and draws that element outwardly from its associated face contacting element by means of inwardly extending projections fixedly mounted on the hopper and arranged to engage parts of the upper planar elements which coincide with edge notches formed on the lower planar element so that movement of the lower planar element away from the upper planar element initiates setting up of the carrier and also effects withdrawal of the lowermost carrier from the hopper.

5 Claims, 15 Drawing Figures

APPARATUS FOR FEEDING FROM A HOPPER AND FOR SETTING UP COLLAPSED ARTICLE CARRIERS

TECHNICAL FIELD

This invention relates to packaging of bottles and more particularly to a method and apparatus for withdrawing from a hopper and for setting up a bottle carrier of the so-called top gripping type and wherein downwardly depending side and end walls constitute integral portions of the carrier.

BACKGROUND ART

U.S. Pat. No. 4,213,283 issued July 22, 1980 and owned by the assignee of this invention discloses a machine for applying carriers of the top gripping type to a plurality of bottles. Carriers manipulated by the machine of U.S. Pat. No. 4,213,283 are of the ordinary top gripping type and are not provided with downwardly depending side and end walls which envelop the sides of the packaged bottles.

DISCLOSURE OF INVENTION

According to this invention in one form, collapsed article carriers stacked in a hopper and having face contacting upper and lower planar elements are fed from the hopper and set up by a pair of oscillatable feeder arms having suction cups for engaging a lowermost planar element and for imparting downward movement thereto while simultaneously a plurality of inwardly extending projections fixedly mounted on the hopper are arranged to engage edge portions of the upper planar element which edge portions are in coincidence with edge notches formed in the lower planar element so that downward movement of the lower planar element results in temporary restraining action of the upper planar element so as to initiate setting up of the carrier. Continued downward movement of the feeder arms and associated suction cups results in complete removal of the carrier from the hopper at which stage a pair of spaced guides receive the partially set up carrier therebetween and retain the carrier in set up condition for subsequent application to a group of bottles disposed therebelow.

BEST MODE OF CARRYING OUT THE INVENTION

Figure 11:
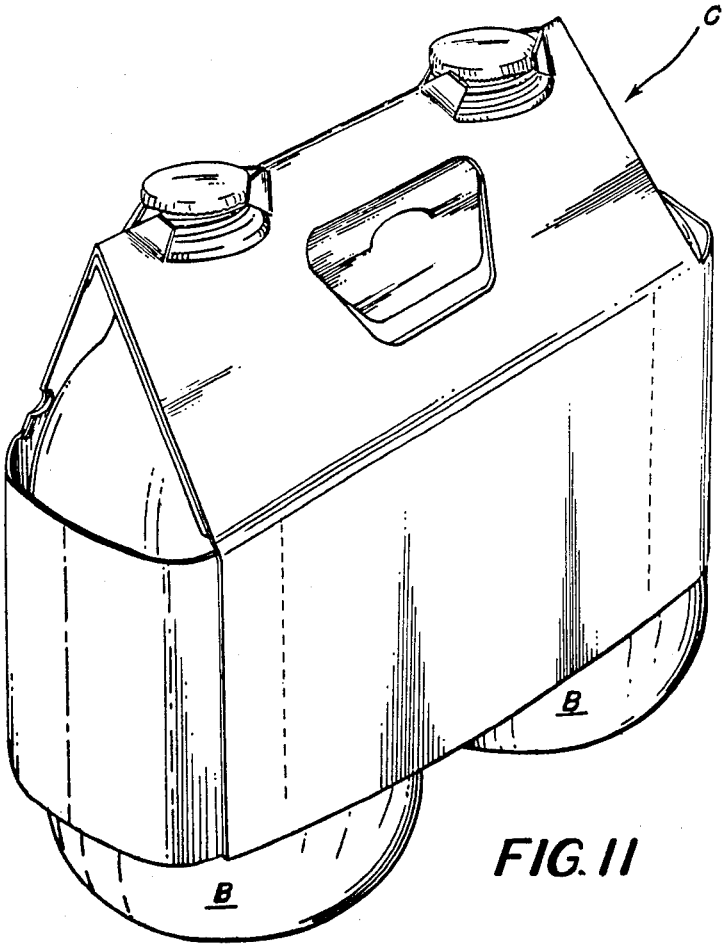
FIG. 11 is a perspective view of a completed carrier including bottles to which the blanks have been applied.
Figure 12:
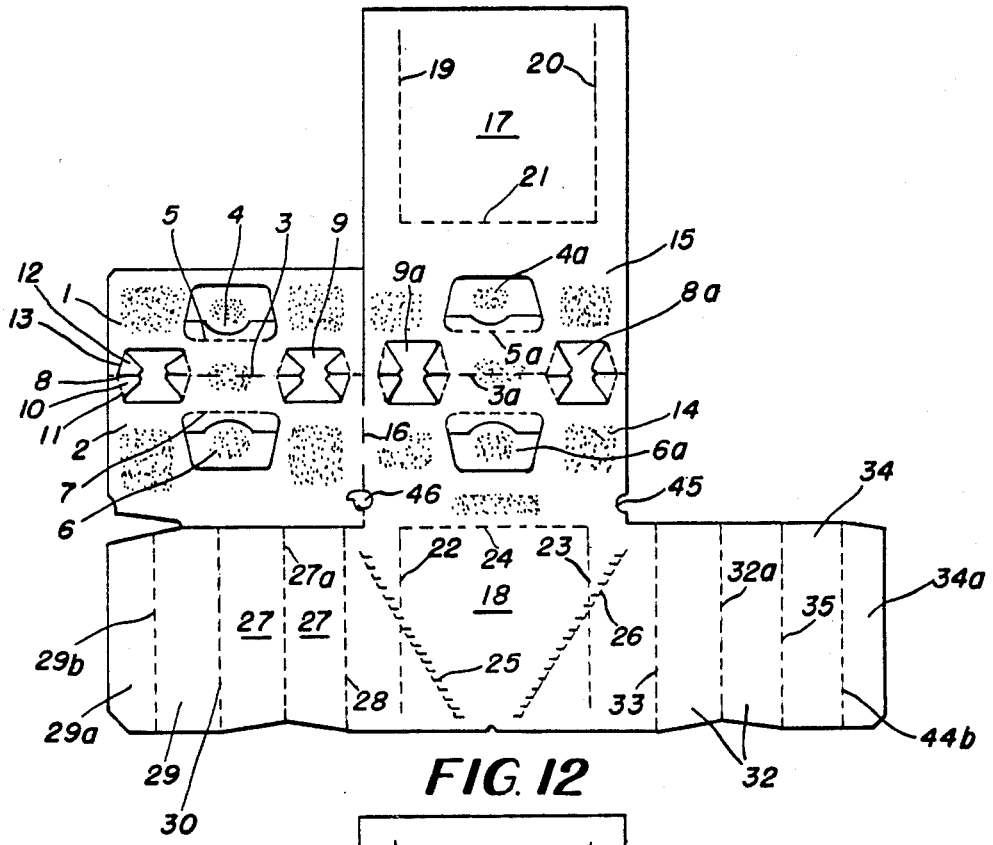
FIG. 12 is a plan view of a blank from which the carrier shown in FIG. 11 is formed and FIGS. 13, 14 and 15 show manipulative stages during which glue is applied to the blank and panels of the blank are manipulated to form a complete collapsed carrier such as is shown in FIG. 15.
Figure 15:
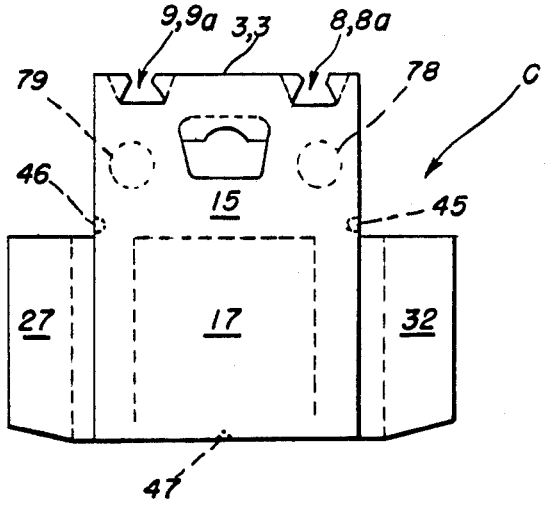

The carrier C shown in set up form in FIG. 11 and shown in collapsed from in FIG. 15 comprises a pair of inner handle panels 1 and 2 which are foldably joined together along the fold line 3 as best shown in FIG. 12. Handle panel 3 is provided with a finger gripping flap 4 which is foldably joined to handle panel 1 along fold line 5. Similarly finger gripping panel 6 is struck from handle panel 2 and is foldably joined thereto along fold line 7. Bottle neck receiving apertures 8 and 9 are formed along the fold line 3 and are struck from handle panels 1 and 2. Neck receiving flaps 10 are foldably joined along fold line 11 to the inner handle panel 2 while bottle neck engaging flaps 12 are struck from handle panel 1 and are foldably joined thereto along fold line 13 as is obvious from FIG. 12. Flaps similar to 10 and 12 are formed on the opposite side of bottle neck receiving aperture 8 and similar flaps are formed on opposite sides of bottle neck receiving aperture 9.

Outer handle panels 14 and 15 are foldably joined together along fold line **3*a* and are provided with elements which are complementary to and identical with the various elements formed in inner panels 1 and 2 and described above. These various elements are generally designated by numerals which correspond to the same numerals used in conjunction with inner handle panels 1 and 2 except that the letter "a" has been added as a suffix to the numerals of outer panels 14 and 15**.

Figure 13:
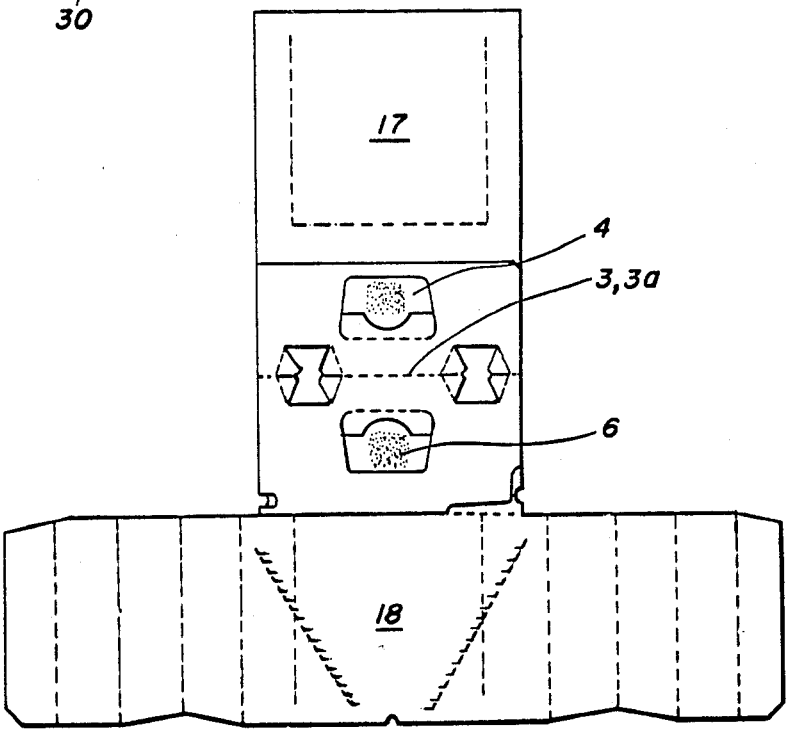

As is apparent from FIG. 13, the inner handle panels 1 and 2 are folded over along fold line 16 into flat face contacting relation to outer handle panels 14 and 15 and become adhered to those panels by virtue of glue applied to the handle panels as indicated by stippling in FIG. 12. Upon completion of this gluing and folding operation the blank appears as shown in FIG. 13.

A downwardly depending side wall 17 is formed integrally with outer panel 15 and downwardly depending side wall 18 is formed integrally with outer handle panel 14. Side wall 17 is provided with weakened crease lines 19, 20 and 21 which are for the purpose of facilitating conformity of the carrier with the packaged bottles associated therewith. Similarly side wall 18 is provided with weakened lines 22, 23 and 24 and tear lines of known construction are formed in side wall 18 and are designated by the numerals 25 and 26.

End wall panel 27 is foldably joined along fold line 28 to an end edge of side wall 18 and a glue flap 29 is foldably joined along fold line 30 to the inner edge of end panel 27. Medial fold line 27*a* is formed in end panel 27.

Similarly at the other end of side wall 18, end wall 32 is foldably joined along fold line 33 to side wall 18 and is provided with a medial fold line 32*a*. Glue flap 34 is foldably joined to end wall 32 along fold line 35. Reinforcing flap 29*a* is adjoined along fold line 29*b* to glue flap 29 while reinforcing flap 34*a* is foldably joined along fold line 44*b* to glue flap 35.

With the blank in the form shown in FIG. 13, panels 29*a*, 29 and the left part of end wall 27 are elevated and folded toward the right along fold line 27*a* while panels 34*a*, 34 and the right hand part of end wall 32 are elevated and folded toward the left along fold line 32*a*. After these folding operations the blank appears as indicated in FIG. 14.

Figure 14:
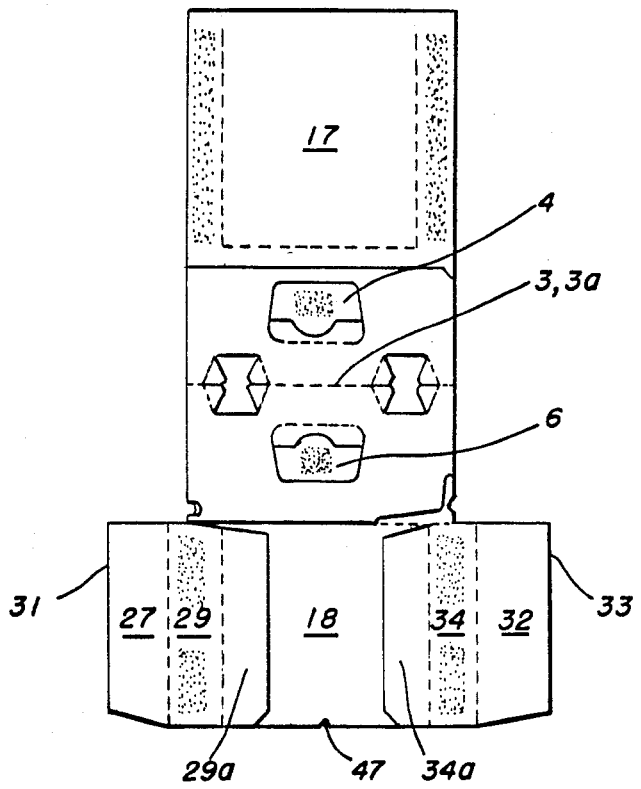

An application of glue is made to the blank shown in FIG. 14 as indicated by stippling in that figure and thereafter those portions of the blank including side wall 17 and the associated outer and inner handle panels 1 and 15 are elevated and folded forwardly along the fold line 3, 3*a* to cause the side edges of side wall 17 to become adhered to glue flaps 29 and 34 and to cause the hand gripping flaps 4 and 6 to become adhered to each other. Thereafter the blank appears in completed collapsed form as shown in FIG. 15.

For cooperating with fixedly mounted hopper elements, edge notch 45 is formed on the right hand edge of outer handle panel 14 and a composite notch 46 is disposed astride fold line 16 and extends into inner handle panel 2 and outer handle panel 14 as best shown in FIG. 12. In like fashion edge notch 47 is formed along the bottom edge of side wall 18. There are no corresponding notches formed in inner handle panel 1 or outer handle panel 15 or in side wall 17. When the carrier is in collapsed form as shown in FIG. 15 for example a portion along the bottom edge of side wall 17 is disposed in coincidence with the bottom notch 47 and portions of inner handle panel 1 and of outer handle panel 15 along their opposite edges overly and coincide with the notches 45 and 46 as indicated by dotted lines in FIG. 14.

Figure 10:
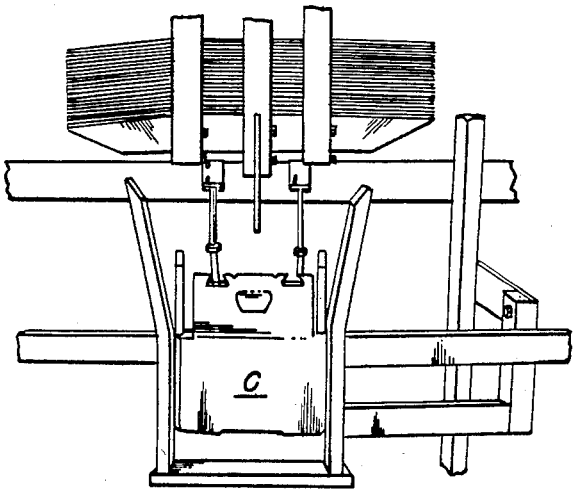
FIG. 10 is a front view of the machine such as that shown in FIG. 1 but which shows the carrier in set up condition ready for application to a group of bottles disposed therebelow.

With carriers in collapsed form as shown in FIG. 15 and stacked one atop another in the hopper H as shown in FIGS. 1–5 inclusive the lowermost carrier is withdrawn from the hopper and set up during its withdrawal movement to occupy the position shown in FIG. 10 according to this invention.

Figure 1:
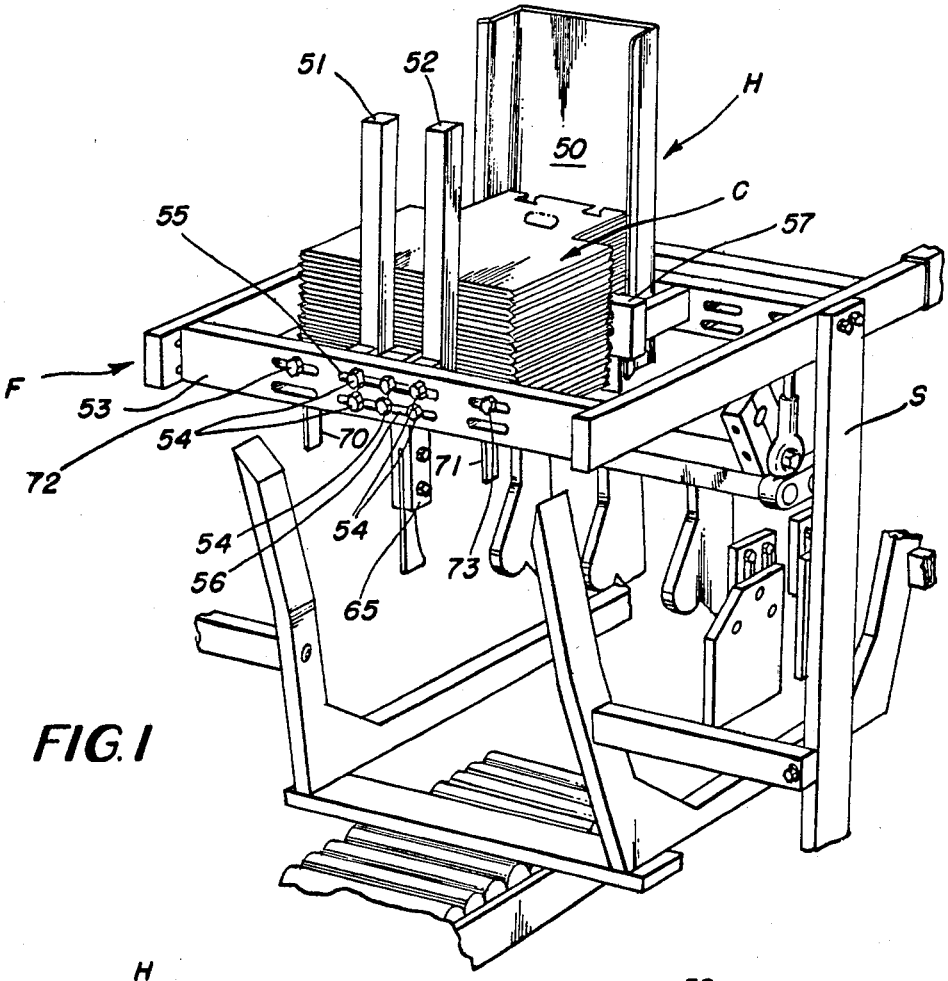
FIG. 1 is a perspective view of a portion of a packaging machine including hopper structure and a stack of collapsed carriers formed according to this invention.
Figure 2:
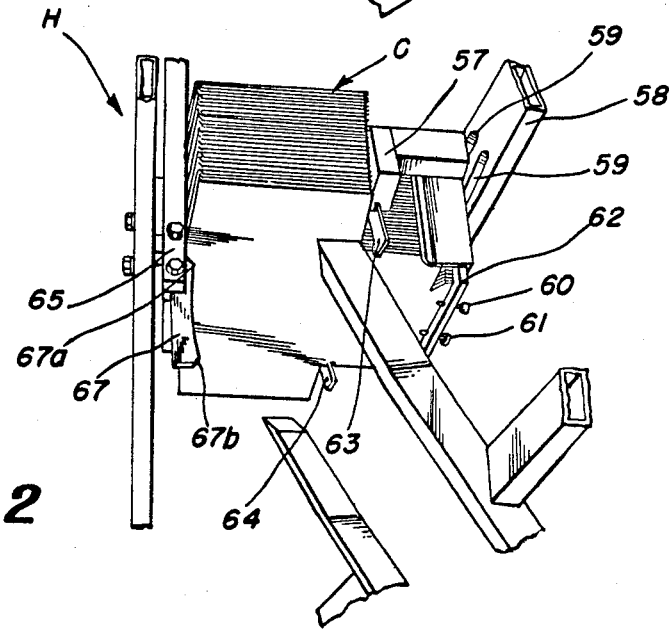
FIG. 2 is a view from below and from one side of a portion of the apparatus shown in FIG. 1.
Figure 6:
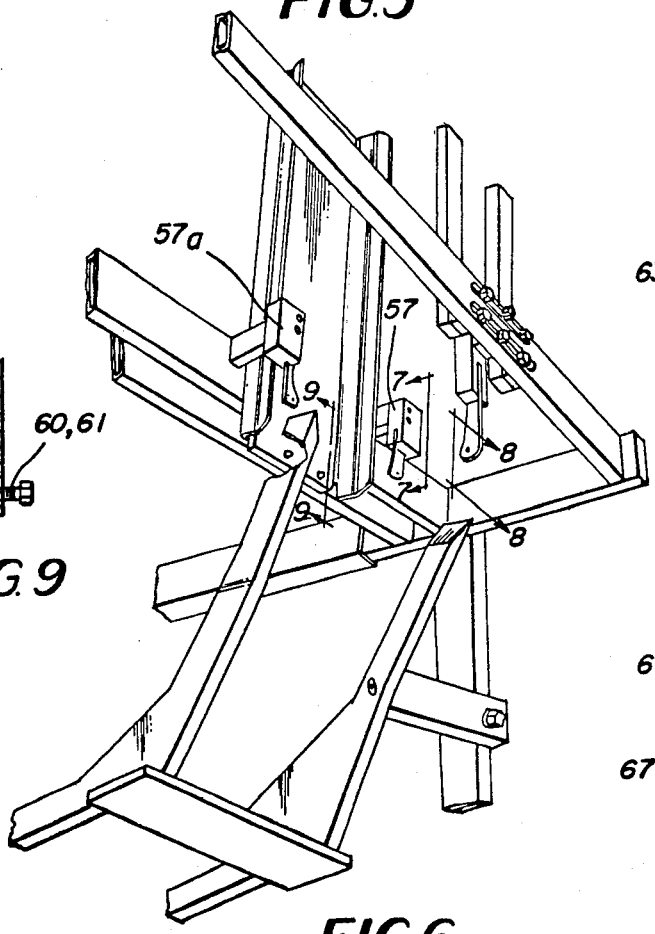
FIG. 6 is a view of the hopper structure with carriers removed and which shows essential features formed according to this invention.

As is apparent in FIGS. 1 and 2 for example hopper H includes a channel shaped back panel 50 which is mounted on a rectangular frame structure generally designated by the letter F which is supported by vertical support elements S. A pair of vertically disposed upright elements 51 and 52 are adjustably mounted on the front panel 53 of frame F by means of a plurality of bolts 54 which are mounted for lateral adjustment in horizontal slots 55 and 56. A pair of support blocks designated by the numerals 57 and 57*a* are mounted on back plate 58 which forms a part of frame F. Blocks 57 are mounted by bolts not shown but which extend through slots 59 formed in panel 58. Only one block 57 is observable in FIGS. 1 and 2, the other block 57*a* being observable in FIG. 6.

For releasably supporting the lowermost carton C within the hopper H, and as best shown in FIG. 2 a pair of detents 60 and 61 are threadedly mounted in plate 62 which is fixedly secured to element 58 as is apparent from the drawings. Detent 60 and 61 project underneath the outer handle panel 14 and engage that handle near its upper edge and between the bottle neck receiving apertures 8 and 9.

For engaging those parts of outer handle panel 15 and of inner handle panel 1 which coincide with the notches 45 and 46 formed in inner handle panels 2 and outer handle panel 14 a pair of inwardly extending projections 63 and 64 are fixedly mounted on support blocks 57 and 57*a* respectively.

Obviously inwardly extending projections 63 and 64 clear the inner handle panel 2 and the outer handle panel 14 by virtue of their coincidence with notches 45 and 46 so that initially the weight of the carrier is taken in part by engagement between inwardly extending projections 63 and 64 and that portion of outer handle panel 15 and inner handle panel 1 which coincides with the notches 45 and 46.

Adjustably mounted on the block 65 by means of bolts 54 in a downwardly and inwardly projecting element 67. Element 67 is arranged to clear side wall 18 by virtue of notch 47 but engages that portion of the bottom edge of side wall 17 as indicated by dotted lines in FIG. 15 so that inwardly projecting element 67 is arranged with its upper part 67*a* providing support for the carrier as is obvious particularly from FIG. 2.

Figure 3:
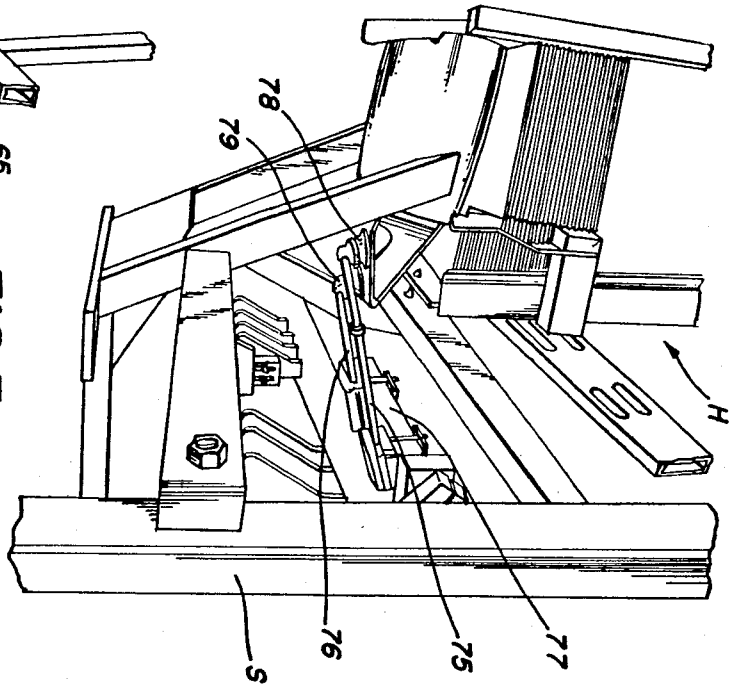
FIG. 3 is a view similar to FIGS. 1 and 2 but which shows the apparatus during the initial stages of withdrawal of the lowermost collapsed carton from the stack of cartons in the hopper.

For maintaining the stack of carriers "C" in proper alignment within the hopper, a pair of guide rods 70 and 71 are mounted by bolts 72 and 73 respectively which extend through horizontal slots formed in panel 53. These guide bars simply insure that the stacked carriers are held in proper orientation relative to the hopper and to other elements of the mechanism so as to insure precise operation. With the carriers arranged in the hopper in stacked relation as shown in FIGS. 1 and 2, the lowermost carrier is withdrawn by means of a pair of feeder arms 75 and 76 which are mounted on oscillatable shaft 77 which is journally oscillatable in frame support S and a corresponding support on the opposite side of the machine. These feeder arms are equipped with suction cups at their swing ends as indicated by the numerals 78 and 79. With suction pressure applied, the suction cups 78 and 79 engage outer handle panel 14 as indicated by dotted line circles on panel 15 in FIG. 15. Counterclockwise swinging movement of feeder arms 75 and 76 initially draws all of the handle panels downwardly and out of engagement with the detents 60 and 61 and the carton then occupies the position approximately as shown in FIG. 3.

Figure 4:
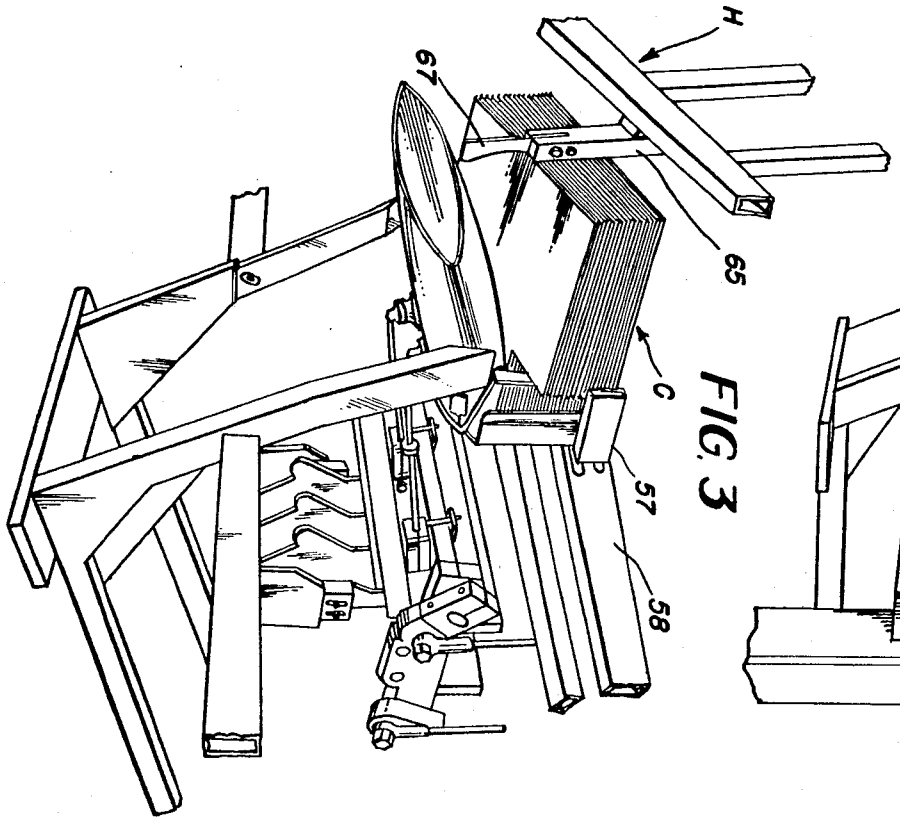
FIG. 4 is a view similar to FIG. 3 but which shows the carton in a succeeding stage of the setting up procedure.
Figure 5:
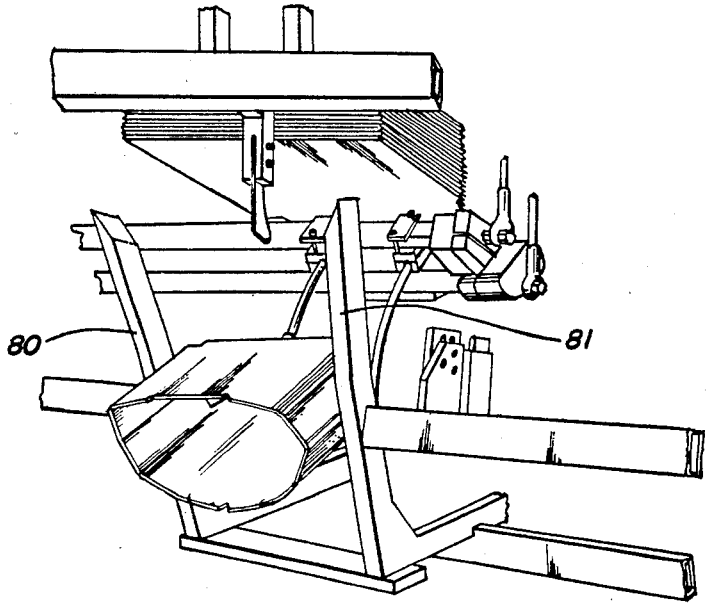
FIG. 5 is a view similar to FIGS. 3 and 4 and which depicts a subsequent stage of the setting up procedure.

Continued counterclockwise swinging movement of feeder arms 75 and 76 next causes the side walls to slide downwardly along the inner edge of inwardly extending projection 67 with the projection 67 riding in notch 47 and ultimately engaging that portion of panel 17 which coincides with notch 47 formed in panel 18. Continued downward counterclockwise movement of feeder arms 75 and 76 draws the side wall 18 away from side wall 17 and separates the outer and inner handle panels as generally indicated in FIG. 4. Thereafter the lower extremity 67*a* of inwardly extending projection 67 disengages the bottom edge of panel 17 and subsequent to such disengagement, the inwardly extending projections 63 and 64 hold the outer handle panel 15 and the associated inner handle panel 1 against downward movement while downward movement of outer handle panel 14 and inner handle panel 2 is accommodated by the notches 45 and 46. When all of the projections disengage the carrier, the structure appears somewhat as shown in FIG. 5. Continued counterclockwise swinging movement of the feeder arms 75 and 76 brings the carrier C to the position represented in FIG. 10 after having been guided and by the guides 80 and 81 which engage the end walls and urge those end walls into flat set up condition as represented in FIGS. 10 and 11. It is apparent from FIG. 5 that the guides 80 and 81 converge downwardly and are of arcuate configuration to track the feeder arms swing ends and and thus aid in completing setting up of the carrier.

Once the carrier is set up and occupies the position represented in FIG. 10 it is ready for applicaion to a pair of bottles disposed immediately therebelow and then appears as shown in FIG. 11 after being applied to the bottles B.

Figure 9:
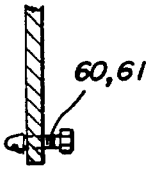
FIG. 9 is a fragmentary cross sectional view of a detent fixedly mounted on the carton structure and which supports and then releases the top edge of the handle of a collapsed carton.

As is shown in FIG. 9 detents such as 60 and 61 are simply threadedly mounted and are rigidly fixed in position once they are properly adjusted.

Figure 7:
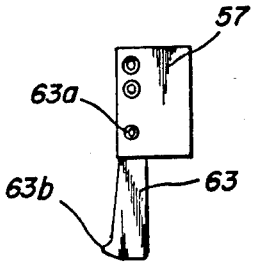
FIG. 7 is an enlarged side view of one projecting element which is fixedly mounted on the hopper and which engages a carton handle side edge.

From FIG. 7 it is apparent that inwardly extending projection 63 is yieldably mounted by virtue of a spring device not shown but which is of the helical type and which is disposed about the bolt 63*a* as best shown in FIG. 7. Thus when the carton is drawn downwardly the projection 63 having lower tip portion 63*b* is yieldable and may swing to the right as viewed in FIG. 7 about 63*a* as a center against the action of the coil spring not shown in the drawing but whose function is obvious.

Figure 8:
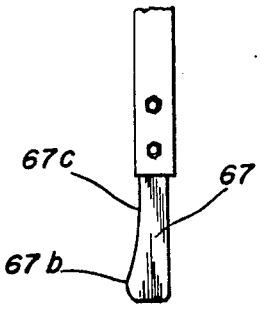
FIG. 8 is a view similar to FIG. 7 but which discloses a different type of inwardly extending projection fixedly mounted on the hopper structure and which engages a bottom edge of a side wall.

From FIG. 8 it is apparent that inwardly extending projection 67 is constructed with a downwardly and inwardly inclined inner edge 67*c* and with an extreme lower protrusion 67*b*.

INDUSTRIAL APPLICABILITY

While the carrier as shown in FIG. 15 can be applied to a pair of bottles by hand, such application is not commercially feasible. Thus the machine and method of this invention provides an efficient high speed arrangement for loading bottles into top gripping type carriers having downwardly depending side and end walls in an efficient and economical manner.

I claim:

1. Apparatus for feeding out of a hopper and for setting up a collapsed article carrier of the top gripping type initially stacked in the hopper with face contacting upper and lower planar elements comprising a pair of handle panels and a pair of side walls foldably joined to said handle panels respectively with outwardly collapsed end walls foldably joined to the ends of said side walls and wherein the lower one of said handle panels is formed with notches on opposite edges thereof, a pair of inwardly extending projections fixedly mounted on said hopper and in engagement with the parts of the upper one of said handle panels which coincide with said notches, each of said inwardly extending projections including a fixed base portion and a yieldable end portion which directly engages said parts of said upper handle panel, at least one notch formed on the bottom edge of the lower one of said side walls and at least one inwardly extending projection fixedly mounted on said hopper and arranged to engage the part of the upper one of said side walls which coincides with said notch, feeder means engageable with said lower planar element for imparting movement thereto in a direction away from said upper planar element thereby to initiate setting up of the carrier, and a pair of fixedly mounted guides disposed in spaced relation to each other and arranged to engage said end walls respectively following release of the carrier from the hopper thereby to aid in setting up the carrier.

2. Apparatus according to claim 1 wherein said inwardly extending projection comprises a vertically disposed element having a downwardly and inwardly inclined inner edge.

3. Apparatus according to claim 1 wherein said handle panels are foldably joined together along their top edges to form a multiple ply handle and wherein a pair of laterally spaced detents are fixedly mounted on said hopper and are releasably engageable with the top edge of said handle.

4. Apparatus according to claim 1 wherein said feeder means comprises at least one pivotally mounted arm having suction means at its swing end and wherein said guides are of arcuate configuration so as approximately to track the swing end of said pivotally mounted arm.

5. Apparatus for feeding out of a hopper and for setting up a collapsed article carrier of the top gripping type which is initially stacked in the hopper with face contacting side and end walls and handle panels and wherein the lower one of said side walls is formed with at least one bottom notch along its bottom edge and the lower one of said handle panels is formed with at least one side notch along each of its opposite side edges respectively, the improvement comprising at least one inwardly extending projection fixedly and adjustably mounted on said hopper and engageable with the upper one of said side walls at the edge position thereof which coincides with said bottom notch, a pair of spaced oppositely disposed inwardly extending projections fixedly mounted on said hopper and having yieldable portions which are respectively arranged to engage the upper one of said handle panels at edge positions which coincide with said notches which are formed in said lower side wall, feeder means engageable with a lower one of said handle panels and operable to impart movement thereto away from the upper handle panel and simultaneously to move said lower side wall away from said upper side wall and to withdraw the carrier from the hopper, and means engageable with portions of said end walls following removal of the carrier from the hopper to manipulate the carrier into set up condition.

* * * * *